US009719183B2

(12) United States Patent
Cordonier et al.

(10) Patent No.: US 9,719,183 B2
(45) Date of Patent: Aug. 1, 2017

(54) NON-CYANIDE GOLD PLATING BATH AND METHOD FOR PREPARING NON-CYANIDE GOLD PLATING BATH

(71) Applicants: Kanto Gakuin School Corporation, Yokohama-shi (JP); JCU CORPORATION, Taito-ku (JP)

(72) Inventors: Christopher Cordonier, Kanagawa (JP); Hideo Honma, Kanagawa (JP)

(73) Assignees: Kanto Gakuin School Corporation, Yokohama-shi (JP); JCU CORPORATION, Taito-ku (JP)

( * ) Notice: Subject to any disclaimer, the term of this patent is extended or adjusted under 35 U.S.C. 154(b) by 81 days.

(21) Appl. No.: 14/414,570

(22) PCT Filed: May 14, 2013

(86) PCT No.: PCT/JP2013/063433

§ 371 (c)(1),
(2) Date: Jan. 13, 2015

(87) PCT Pub. No.: WO2014/010301

PCT Pub. Date: Jan. 16, 2014

(65) Prior Publication Data

US 2015/0167191 A1 Jun. 18, 2015

(30) Foreign Application Priority Data

Jul. 13, 2012 (JP) ..... 2012-157450

(51) Int. Cl.
*C25D 3/48* (2006.01)
*C25D 3/02* (2006.01)
(Continued)

(52) U.S. Cl.
CPC ..... *C25D 3/48* (2013.01); *C23C 18/31* (2013.01); *C23C 18/44* (2013.01)

(58) Field of Classification Search
CPC .. C25D 3/48; C25D 3/02; C23C 18/31; C23C 18/44; C23C 18/1651; C23C 18/1653
(Continued)

(56) References Cited

U.S. PATENT DOCUMENTS 5,401,535 A * 3/1995 Bishop ..... 427/229
2005/0067297 A1* 3/2005 Tench ..... C25D 3/38 205/296
(Continued)

FOREIGN PATENT DOCUMENTS

JP 2010-255010 A 11/2010

OTHER PUBLICATIONS

Kato et al. "Some Recent Developments in Non-Cyanide Gold Plating for Electronics Applications" Gold Bulletin 2004 • 37-44.*
(Continued)

*Primary Examiner* — Zulmariam Mendez
(74) *Attorney, Agent, or Firm* — Oblon, McClelland, Maier & Neustadt, L.L.P.

(57) ABSTRACT

A non-cyanide gold plating bath 1 contains gold ions and a compound represented by the following chemical formula (chem 1):

12 Claims, 2 Drawing Sheets

(51) Int. Cl.
*C23C 18/44* (2006.01)
*C23C 18/31* (2006.01)

(58) Field of Classification Search
USPC ..... 205/464, 267, 126, 163, 167, 187, 794; 427/212
See application file for complete search history.

(56) References Cited

U.S. PATENT DOCUMENTS

2009/0022885 A1 1/2009 Matsumoto et al.
2012/0129005 A1* 5/2012 Asakawa ..... C23C 18/1637 428/672

OTHER PUBLICATIONS

Jin et al. "Electrochemical Design of Ultrathin Platinum-Coated Gold Nanoparticle Monolayer Films as a Novel Nanostructured Electrocatalyst for Oxygen Reduction" J. Phys. Chem. B 2004, 108, 8142-8147.*
Templeton et al. "Redox and Fluorophore Functionalization of Water-Soluble, Tiopronin-Protected Gold Clusters" J. Am. Chem. Soc. 1999, 121, 7081-7089.*
Templeton et al. "Water-Soluble, Isolable Gold Clusters Protected by Tiopronin and Coenzyme A Monolayers" Langmuir 1999, 15, 66-76.*
International Search Report issued Jun. 11, 2013 in PCT/JP2013/063433 Filed May 14, 2013.
Office Action issued on Jan. 21, 2015 in the corresponding Taiwanese Patent Application No. 102124750.

* cited by examiner

NON-CYANIDE GOLD PLATING BATH AND METHOD FOR PREPARING NON-CYANIDE GOLD PLATING BATH

CROSS-REFERENCE TO RELATED APPLICATIONS

This application is a National Stage of PCT/JP2013/063433 filed on May 14, 2013. This application is based upon and claims the benefit of priority to Japanese Application No. 2012-157450, which was filed on Jul. 13, 2012, the entire contents of which are incorporated herein by reference.

TECHNICAL FIELD

The present invention relates to a non-cyanide gold plating bath containing a complexing agent capable of retaining gold ions stably and a method for preparing the non-cyanide gold plating bath.

BACKGROUND ART

A gold plating film has excellent electric characteristics, corrosion resistance, solderability and the like. Due to these properties, a gold plating film is being frequently used in production of electronic members, such as a circuit board. A gold plating film is also being applied to an ornamental use due to the peculiar luster and color tone thereof.

As a gold plating bath, a cyanide bath having a cyanide compound added thereto for retaining gold ions stably in the bath has been used over the years. However, a cyanide bath is not only necessarily handled and stored with extreme attention due to the toxicity thereof, but also may not be used for plating a circuit board having fine resist pattern since the bath damages the resist.

Under the circumstances, various non-cyanide plating baths have been proposed. For example, JP-A-2006-111960 describes a non-cyanide displacement plating bath having thiouracil, aminoethanethiol, methylthiourea, aminomercaptotriazole, dihydroxymercaptopyrimidine or mercaptonicotinic acid for retaining gold ions stably.

JP-A-2000-26977 describes a noble metal electroless plating bath having as a reducing agent mercaptoacetic acid, 2-mercaptopropionic acid, 2-aminoethanethiol, 2-mercaptoethanol, glucose-cysteine, 1-thioglycerol, sodium mercaptopropanesulfonate, N-acetylmethionine, thiosalicylic acid, 2-thiazoline-2-thiol, 2,5-dimercapto-1,3,4-thiadiazole, 2-benzothiazolethiol or 2-benzimidazolethiol.

However, a more stable non-cyanide gold plating bath and a method for producing the non-cyanide gold plating bath have been demanded.

SUMMARY OF INVENTION

Technical Problem

An object of an embodiment of the invention is to provide a stable non-cyanide gold plating bath and a method for producing the non-cyanide gold plating bath.

Solution to Problem

A non-cyanide gold plating bath of an embodiment of the invention contains gold ions and a compound represented by the following chemical formula (chem 1):

(chem 1)

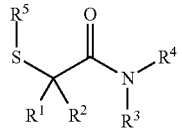

A method for producing a non-cyanide gold plating bath of another embodiment of the invention contains a step of forming a monovalent gold complex from a trivalent gold ion and a compound represented by the chemical formula (chem 1), a step of isolating the monovalent gold complex, and producing a gold plating bath by using the isolated monovalent gold complex.

(chem 1)

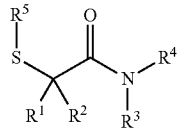

DESCRIPTION OF EMBODIMENTS

First Embodiment

Figure 1:
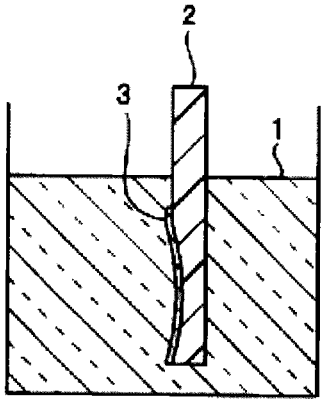
FIG. 1 is a schematic illustration showing formation of a gold plating film with an electroless plating bath of an embodiment.

A plating bath 1, 2 (see FIG. 1) of the first embodiment is a non-cyanide electroless gold plating bath that contains gold ions, tiopronin as the compound represented by the chemical formula (chem 1), and sodium hypophosphite as a reducing agent, as shown below. The "mol/L" will be abbreviated as "M" hereinafter.

(chem 2)

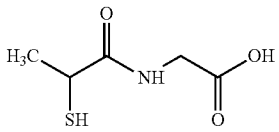

Plating Bath 1

| | |
|---|---|
| sodium chloraurate | 0.005 M |
| tiopronin | 0.025 M |
| citric acid | 0.125 M |
| bipyridyl | 100 ppm |
| PEG 200 | 100 ppm |
| sodium hypophosphite | 0.02 g/L |
| bath temperature | 80° C. |
| pH 7 (adjusted with potassium hydroxide and sulfuric acid) | |

Plating Bath 2

| | |
|---|---|
| sodium chloraurate | 0.02 M |
| tiopronin | 0.10 M |
| citric acid | 0.50 M |
| bipyridyl | 500 ppm |
| PEG 200 | 500 ppm |
| ascorbic acid | 0.10 M |
| bath temperature | 60° C. |
| pH 4.25 (adjusted with potassium hydroxide and sulfuric acid) | |

The source of gold ions used may be preferably a chloraurate salt, gold hydroxide, gold sulfite or the like, and from the standpoint of cost, handleability and stability, sodium chloraurate, which is a gold salt having trivalent gold, is particularly preferred.

The concentration C of gold ions is preferably from 0.001 to 0.1 M. When the concentration is the range or more, the deposition reaction may proceed stably, and when the concentration is the range or less, the reaction may proceed economically without formation of precipitate.

Tiopronin (mercaptopropionylglycine) as the main complexing agent is shown by the following chemical formula (chem 2).

(chem 2)

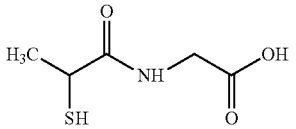

Tiopronin is generally used as a medical drug, but has not yet been considered for plating purpose.

The concentration M of the main complexing agent is preferably from 1 to 10 in terms of the ratio (M/C) to the gold ion concentration C, and when the concentration is in the range, a considerably stable complex may be formed. For example, in the case where the concentration C of sodium chloraurate is 0.04 M, the concentration M of tiopronin of 0.20 M provides M/C=5, which is the same as in the plating bath 1.

The main complexing agent used may be a compound represented by the chemical formula (chem 1) and may be 6-aminopenicillanic acid (6-APA) shown by the following formula (chem 3) instead of tiopronin.

(chem 3)

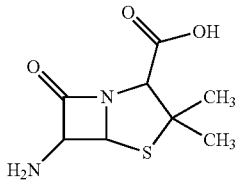

6-Aminopenicillanic acid has a mother nucleus of a penicillin drug, but has not yet been considered for plating purpose as similar to tiopronin.

Thus, the inventors have found that tiopronin and 6-aminopenicillanic acid, which are compounds represented by the chemical formula (chem 1), exhibit excellent characteristics as a complexing agent for gold plating. Examples of the compound represented by the chemical formula (chem 1) also include 2-mercaptoacetamide, 2,2'-bis-acetamide disulfide, 2-thiophenecarboxamide, rhodanine, 2,4-thiazolidinedione, 2-thiophenecarboxilic hydrazide, rhodanine-3-acetic acid, 1,4-benzothiazin-3-one, 3,5-dimethyl-1-(2-thienylcarbonyl)-1H-1,2,4-triazole, n-phenyl-2-(phenylthio)acetamide and n-phenyl-1-benzothiophene-2-carboxamide.

The reason why the compound represented by the chemical formula (chem 1) shows excellent characteristics as a complexing agent for gold plating has not yet been sufficiently clarified. On preparing the plating bath 1, the yellow solution is changed to colorless on adding the main complexing agent, such as tiopronin. It may be considered therefrom that trivalent gold ions of sodium chloraurate are changed to monovalent gold ions on forming complexes through reduction with tiopronin or the like, and thus are stabilized considerably.

As the main complexing agent, one or more of the compounds, for example, tiopronin and 6-aminopenicillanic acid, may be used in combination.

Citrate ions function as an auxiliary complexing agent, and examples of the auxiliary complexing agent used include various water-soluble compounds, such as Rochelle salt (tartaric acid), ethylenediaminetetraacetic acid (EDTA), aspartic acid, glutamic acid, succinic acid, citric acid, malic acid, 3-hydroxypropionic acid, malonic acid, galacturonic acid, gluconic acid, hydroxybutyric acid, 2,2-bis(hydroxymethyl)butyric acid, hydroxy pivalic acid, β-hydroxyisovaleric acid, oxalic acid, salicylic acid, and salts and derivatives of these compounds. Examples of the auxiliary complexing agent that may also be used include a thioamine compound, a diamine compound and a thiourea compound. Tartarate ions and citrate ions are preferred since they form a stable composite complex with the compound represented by the chemical formula (chem 1) as the main complexing agent, and citrate ions are particularly preferred from the standpoint of the stability and the water solubility. Tartarate ions and citrate ions may be used in combination as the auxiliary complexing agent. In the case where the compound used is in the form of a salt, a potassium salt is preferred rather than a sodium salt since a gold plating film having good luster may be obtained.

The concentration N of the auxiliary complexing agent, such as citrate ions, is preferably from 1 to 50 in terms of the ratio (N/M) to the concentration M of the main complexing agent, such as tiopronin, and when the concentration is in the range, a considerably stable complex may be formed. Accordingly, the ratio of (concentration C of gold ions)/(concentration M of the main complexing agent)/(concentration N of the auxiliary complexing agent) is preferably 1/(1 to 10)/(1 to 50), and for example, 1/5/25 in the plating bath 1, 2. Note that the names of the main complexing agents and the auxiliary complexing agents are ones for convenience.

Hypophosphite ions are a reducing agent for gold ions, and the source thereof used may be sodium hypophosphate, potassium hypophosphate or the like. The concentration G (g/L) of hypophosphite ions is preferably from 1 to 10 in terms of the ratio (G/C) to the concentration C of gold ions. When the concentration is the range or more, the deposition reaction may proceed stably, and when the concentration is the range or less, the plating bath may not undergo self-decomposition. For example, in the case where the gold ion concentration is 0.01 M, the hypophosphite ion concentration may be 0.04 M to provide a ratio G/C of 4, which is the same as the plating bath 1. Examples of the reducing agent used also include ascorbic acid, thiourea, DMAB, formalin and hydrazine, and hypophosphoric acid and ascorbic acid are preferred.

Bipyridyl and PEG 200 (polyethylene glycol having a molecular weight of 200) are so-called brightening agent and surfactant, and may be added in suitable amounts. Examples of the brightening agent and surfactant used also include phenanthroline and picoline (methylpyridine).

Potassium hydroxide and sulfuric acid are pH modifiers, and sodium hydroxide, potassium hydroxide, aqueous ammonia and the like may also be used. The plating bath 1 is a neutral bath having pH of from 6 to 8, and may be an acidic bath having pH of from 2 to 7 or an alkaline bath having pH of from 7 to 14, depending on the kind of the reducing agent used.

Accordingly, the gold plating bath having the combination of the main complexing agent and the auxiliary complexing agent of this embodiment exhibits stable characteristics over a wide pH range of from acidity to alkalinity. It is considered as having been described above that this is because a particularly stable complex is formed by the combination of the main complexing agent having a function of reducing trivalent gold ions to monovalent gold ions and the auxiliary complexing agent. In the state with the stable complex present, monovalent gold ions are not reduced to metallic gold with the reducing power of the main complexing agent, and monovalent gold ions are reduced to metallic gold only with a reducing agent having larger reducing power.

Film Forming Method

As shown in FIG. 1, COP (cycloolefin polymer) is used as a substrate 2, which is subjected to known pretreatments (such as an ultraviolet ray irradiation treatment, an alkali treatment, a conditioning treatment, a palladium ion treatment and a reducing treatment) and then immersed in the plating bath 1 for 30 minutes, thereby providing a glossy gold plating film 3.

The electroless plating bath 1, 2 is stable after retaining at 80° C. for 72 hours, and suffers no problem after storing at ordinary temperature for one month.

Consequently, the electroless plating bath 1, 2 is significantly stable.

Second Embodiment

A plating bath 1A (see FIG. 2) of the second embodiment is a non-cyanide electrolytic gold plating bath that contains gold ions and 6-aminopenicillanic acid (6-APA).

Plating Bath 1A

| | |
|---|---|
| sodium chloraurate | 0.01 M |
| 6-aminopenicillanic acid | 0.05 M |
| citric acid | 0.25 M |
| bipyridyl | 100 ppm |
| PEG 200 | 100 ppm |
| bath temperature | 80° C. |
| pH 12 (adjusted with potassium hydroxide) | |

Film Forming Method

Figure 2:
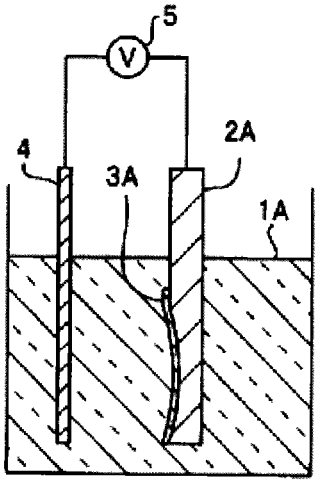
FIG. 2 is a schematic illustration showing formation of a gold plating film with an electrolytic plating bath of an embodiment.

As shown in FIG. 2, a copper plate 2A used for a substrate as a cathode and a titanium platinum plate 4 as an anode are subjected to known pretreatment (such as acid cleaning) and then subjected to electrolytic plating for 30 minutes at an electric current density of 1 A/dm$^2$ with an electric power source 5, thereby providing a glossy gold plating film 3A. A glossy gold plating film is also obtained by using an iron plate, a conductive Si wafer or a nickel plate as the cathode.

In the electrolytic plating bath 1A, a particularly stable complex is formed by the combination of the main complexing agent (6-aminopenicillanic acid) having a function of reducing trivalent gold ions to monovalent gold ions and the auxiliary complexing agent (citric acid), as similar to the electroless plating bath 1 and the like.

An electrolytic plating bath that contains no 6-aminopenicillanic acid is not so stable as compared to the electrolytic plating bath 1A, and exhibits a film forming rate at the same electric current density of approximately ⅓ of that of the electrolytic plating bath 1A. This is because trivalent gold ions are reduced to monovalent gold ions with 6-aminopenicillanic acid. Accordingly, the electrolytic plating bath 1A has better deposition efficiency than an electrolytic plating bath that contains no 6-aminopenicillanic acid.

The electrolytic plating bath 1A suffers no problem after storing at ordinary temperature for one month.

Consequently, the electrolytic plating bath 1A is significantly stable.

The plating bath 1A is an alkaline bath having pH of 12, and may be a neutral bath having pH of from 6 to 8 or an acidic bath having pH of from 4 to 6. Accordingly, the gold plating bath 1A having the combination of the main complexing agent and the auxiliary complexing agent of this embodiment exhibits stable characteristics over a wide pH range of from acidity to alkalinity.

As the auxiliary complexing agent, glycine, dimethylsulfoxide, a mercaptoalkanesulfonic acid, nitrilotriacetic acid, sulfurous acid and carbonic acid may be used. In particular, carbonic acid has an effect that is equivalent to citric acid and may be preferably used. Hydrogen peroxide may be used as a reducing agent. The only by-product that is formed through the reduction reaction with hydrogen peroxide is oxygen, which does not adversely affect electroless plating.

In the case where the electroless plating bath 1 is an acidic bath, the bath preferably has pH of 3.5 or more.

Third Embodiment

In the plating bath 1 of the first embodiment, trivalent gold ions of sodium chloraurate are changed to monovalent gold ions on forming complexes through reduction with tiopronin, and thus are stabilized considerably. However, as shown in the following scheme (scheme 1), a ⅔ portion of tiopronin is oxidized to be a disulfide through the reduction reaction of gold ions. The disulfide and the like are impurities that are unnecessary in the plating bath, and may cause deterioration of the plating bath and adverse influence to the plating film in the continuous use.

(scheme 1)

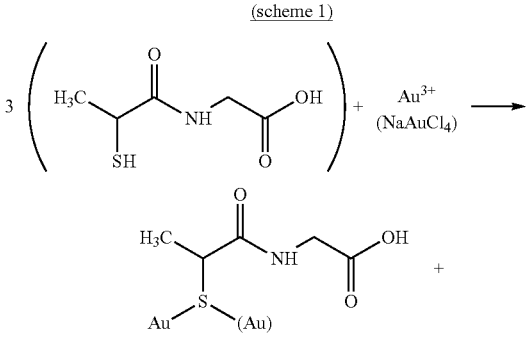

-continued

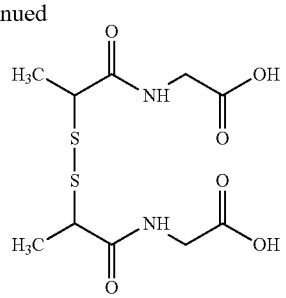

In a method for producing a plating bath 1B in the third embodiment, on the other hand, before the plating bath 1B is prepared, a complex of monovalent gold ions and tiopronin (which may be hereinafter referred to as RSG) is prepared in advance, and the plating bath 1B is produced by using the isolated monovalent gold complex RSG.

Figure 3:
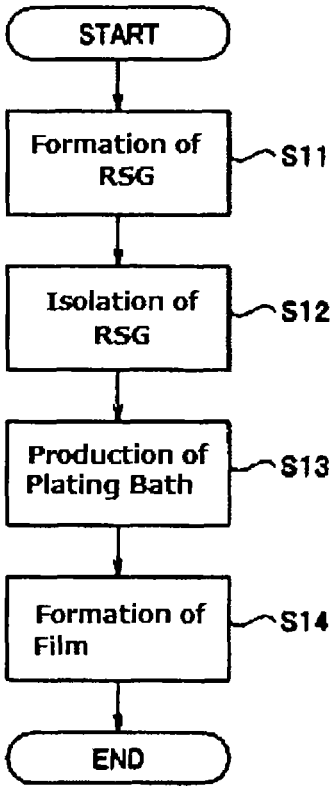
FIG. 3 is a flow diagram showing a method for producing a plating bath of a third embodiment.

The method for producing the plating bath 1B will be described below with reference to the flow diagram shown in FIG. 3.

Step S11, Formation of RSG

An aqueous solution containing 0.15 M of tiopronin, 0.50 M of acetic acid and 0.05 M of sodium chloraurate is stirred at room temperature for 10 hours. Thus, tiopronin is used in an amount of three times the amount of monovalent gold ions.

The aqueous solution has pH of 3 or less, and thus RSG thus formed is not dissolved but is in the form of fine particles. A carboxylic acid, such as citric acid and tartaric acid, may be used instead of acetic acid.

Step S12, Isolation of RSG

The aqueous solution having RSG dispersed therein is filtered with a membrane filter of 0.4 μm to isolate RSG from an aqueous solution containing impurities including a disulfide, chloride ions, sodium ions and the like dissolved therein. The isolation herein means that the by-products and the like formed through the reaction are separated from RSG. Instead of the filtration for isolation, the aqueous solution having by-products and the like dissolved therein and RSG may be separated by a centrifugal separation method.

The yield of gold in the RSG production and isolation steps is 99.9%.

Step S13, Production of Plating Bath

An aqueous solution containing 0.02 M of RSG is adjusted to pH of 9 by adding potassium carbonate to dissolve RSG therein, thereby providing an electrolytic plating bath 1B. Thus, the electrolytic plating bath 1B has a considerably simple composition that contains as basic components only monovalent gold ions and tiopronin as a main complexing agent. However, the electrolytic plating bath 1B suffers no problem after storing at ordinary temperature for six months.

Potassium hydroxide or aqueous ammonia may be used for adjusting the pH. RSG is dissolved at pH of 4 or more, and the electrolytic plating bath preferably has pH of from 8 to 12 from the standpoint of the stability.

Step S14, Formation of Film

A copper plate 2A used for a substrate as a cathode and an iridium oxide-coated titanium plate 4 as an anode are subjected to known pretreatment (such as acid cleaning) and then subjected to electrolytic plating for 3 minutes at an electric current density of 1 A/dm$^2$ with an electric power source 5, thereby providing a glossy gold plating film 3B having a thickness of 475 nm.

The electroplating bath B1 is stable during use, after use and during reuse, without coloration of the plating bath or large fluctuation of the deposition rate.

The gold plating bath 1B of this embodiment has the same effects as the gold plating bath 1 and the like, and is excellent in the stability during use and after use as compared to the gold plating bath 1 and the like.

Modified Embodiments of Third Embodiment

RSG produced by the method of the third embodiment may also be used in a displacement plating bath 1B1 and an electroless plating bath 1B2.

For example, the displacement plating bath 1B1 may be prepared by adjusting an aqueous solution containing 0.005 M of RSG to pH of 5 with potassium hydroxide. A Ni plate is immersed in the displacement plating bath 1B1 at 80° C., and thereby a displacement plating film 3B1 is formed at a rate of 8.2 nm/min.

The displacement plating bath 1B1 suffers no problem after storing at ordinary temperature for one month. The displacement plating bath 1B1 is stable during use, after use and during reuse, without coloration of the plating bath or large fluctuation of the deposition rate.

For example, the electroless plating bath 1B2 may be prepared by adding 0.010 M of aminomercaptothiadiazole (AMT) and 0.010 M of ascorbic acid to an aqueous solution containing 0.010 M of RSG and adjusting the solution to pH of 5 with potassium hydroxide. ATM is an accelerator, and ascorbic acid is a reducing agent.

For example, a glass substrate having an Au film formed thereon is immersed in a solution of SBH (sodium borohydride) of 2 g/L (50° C.) for 2 minutes for a reducing treatment and then immersed in the electroless plating bath 1B2 for 2 hours, and thereby a dull gold plating film 3B2 of 760 nm is formed.

The electroless plating bath 1B2 before adding ascorbic acid suffers no problem after storing at ordinary temperature for one month.

The gold plating baths 1B, 1B1 and 1B2 may further contain known additives. For example, the displacement plating bath 1B1 or the electroless plating bath 1B2 may further contain a suitable amount of citric acid, thereby achieving further stabilization and improvement of properties of the plating film.

For example, an electroless plating bath 1B3 formed by adding 0.10 M of glycine, 0.100 M of citric acid, 0.001 M of bipyridyl, 400 ppm of PEG 600 and 0.010 M of potassium sulfite to the electroless plating bath 1B2 forms a glossy gold plating film 3B3 of 400 nm under the same conditions for the electroless plating bath 1B2.

Bipyridyl is a brightening agent and a leveler, PEG 600 is a surfactant, and potassium sulfite is a stabilizer.

A displacement plating bath 1B4 formed by adding 0.100 M of citric acid to the displacement plating bath 1B1 exhibits a deposition rate that is larger than the displacement plating bath 1B1.

The displacement plating baths 1B1 and 1B4 and the electroless plating baths 1B2 and 1B3 of the modified embodiments are excellent in stability as compared to the gold plating bath 1 and the like, as similar to the gold plating bath 1B and the like.

Fourth Embodiment

In the method for producing a plating bath of the third embodiment, a ⅔ portion of tiopronin is oxidized to be a disulfide as shown in the scheme (scheme 1).

In the method for producing a plating bath of this embodiment, on the other hand, sulfite ions are added on forming RSG, and thereby tiopronin is not oxidized to a disulfide as shown in the scheme (scheme 2).

(scheme 2)

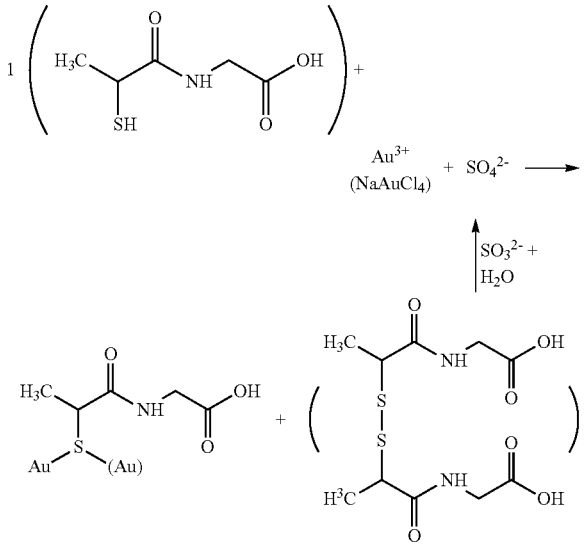

In the production method of this embodiment, in the step S11 of the production of RSG, an aqueous solution containing 0.05 M of tiopronin, 0.50 M of citric acid, 0.05 M of sodium chloraurate and 0.20 M of potassium sulfite is stirred at room temperature for 1 hour, and further stirred at 80° C. for 3 hours. Thus, tiopronin is used in an equimolar amount of monovalent gold ions, and sulfite ions are used in an amount of twice the amount of monovalent gold ions.

RSG is then isolated by a centrifugal separation method. In the production method of RSG in this embodiment, the yield of gold is 97.7%. RSG produced by the method of this embodiment has the same effects as RSG produced by the method of the third embodiment on using in a plating bath.

A sulfite salt as the sulfite ion source is inexpensive as compared to tiopronin. Accordingly, the method for producing a plating bath of this embodiment has the same effects as the method for producing a plating bath of the third embodiment, and is further economical.

In the methods for producing a plating bath of the third embodiment, the modified embodiments of the third embodiment, and the fourth embodiment, the compound represented by the chemical formula (chem 1), such as 6-aminopenicillanic acid, may be used instead of tiopronin. Specifically, a monovalent gold ion complex produced by using the compound represented by the chemical formula (chem 1) may be isolated and added to a plating bath or applied to the reduction reaction with sulfite ions.

With 6-aminopenicillanic acid, it is not easy to isolate the monovalent gold ion complex with high purity as compared to tiopronin, and the stability of the plating bath is slightly low.

As described in the foregoing, the non-cyanide gold plating bath having added thereto the isolated monovalent gold ion complex, which is formed with the compound represented by the chemical formula (chem 1) and trivalent gold ions, is excellent in stability during use and after use, as compared to a non-cyanide gold plating bath produced by adding the compound represented by the chemical formula (chem 1) and trivalent gold ions thereto.

The monovalent gold ion complex formed with the compound represented by the chemical formula (chem 1), trivalent gold ions and sulfite ions is economical.

The invention is not limited to the aforementioned embodiments and the like, and various changes, modifications, combinations and the like may be made therein unless the substance of the invention is changed.

The present application is filed based on the priority of Japanese Patent Application No. 2012-157450 filed on Jul. 13, 2012, and the disclosed contents therein are incorporated by reference in the specification, the claims and the drawings of the present application.

The invention claimed is:

1. An electroless gold plating liquid, comprising:

(a) an isolated complex of monovalent gold ions obtained by stirring an aqueous solution comprising a main complexing agent, a carboxylic acid, and a source of gold ions selected from the group consisting of a chloroaurate salt, gold hydroxide and a gold sulfite salt, and then subjecting the aqueous solution to isolation;

(b) aminomercaptothiadiazole; and (c) a reducing agent, wherein:

the main complexing agent is at least one compound selected from the group consisting of 2-mercaptoacetamide, 2,2'-bis-acetamide disulfide, 2-thiophenecarboxamide, rhodanine, 2,4-thiazolidinedione, 2-thiophenecarboxilic hydrazide, rhodanine-3-acetic acid, 1,4-benzothiazin-3-one, 3,5-dimethyl-1-(2-thienylcarbonyl)-1H-1,2,4-triazole, N-phenyl-2-(phenylthio)acetamide, N-phenyl-1-benzothiophene-2-carboxamide, 6-aminopencillanic acid, and tiopronin; and the electroless gold plating liquid has a pH of 3.5 or higher.

2. The electroless gold plating liquid according to claim 1, wherein the main complexing agent is at least one of tiopronin and 6-aminopenicillanic acid.

3. The electroless gold plating liquid according to claim 1, wherein a ratio of (concentration C of gold ions)/(concentration M of the main complexing agent)/ is 1/(1 to 10).

4. The electroless gold plating liquid according to claim 1, wherein the reducing agent is at least one of a hypophosphite salt and ascorbic acid.

5. The electroless gold plating liquid according to claim 1, wherein the aqueous solution further comprises sulfite ions.

6. A plating method, comprising plating a substrate in the gold plating liquid of claim 1 to form a gold plating film on a surface of the substrate.

7. The plating method of claim 6, wherein the plating occurs by electroless plating.

8. The electroless gold plating liquid according to claim 1, wherein the auxiliary complexing agent is citric acid.

9. The electroless gold plating liquid according to claim 1, wherein the main complexing agent is tiopronin.

10. The electroless gold plating liquid according to claim 1, wherein the source of gold ions is sodium chloraurate.

11. The electroless gold plating liquid according to claim 1, wherein the reducing agent is ascorbic acid.

12. The electroless gold plating liquid according to claim 1, wherein the carboxylic acid is acetic acid, citric acid or tartaric acid.

* * * * *